United States Patent [19]

Scott et al.

[11] 4,140,267

[45] Feb. 20, 1979

[54] CARTON WITH INTEGRAL REINFORCED CARRYING HANDLE

[75] Inventors: Raymond G. Scott, Oak Brook; Lawrence S. Wysocki, Chicago, both of Ill.

[73] Assignee: Champion International Corporation, Stamford, Conn.

[21] Appl. No.: 877,225

[22] Filed: Feb. 13, 1978

[51] Int. Cl.[2] ..... B65D 5/46

[52] U.S. Cl. ..... 229/52 B

[58] Field of Search ..... 229/52 B, 37

[56] References Cited

U.S. PATENT DOCUMENTS

| | | | |
|---|---|---|---|
| 2,158,697 | 5/1939 | Harrison | 229/52 A |
| 2,942,771 | 6/1960 | Spigelman | 229/52 A |
| 3,801,012 | 4/1974 | Thelen | 229/52 A |

FOREIGN PATENT DOCUMENTS

| | | | |
|---|---|---|---|
| 254763 | 6/1967 | Austria | 229/52 B |
| 112158 | 11/1968 | Denmark | 229/52 B |
| 2413819 | 10/1974 | Fed. Rep. of Germany | 229/52 B |
| 2459705 | 7/1976 | Fed. Rep. of Germany | 229/52 B |
| 1335441 | 6/1974 | United Kingdom | 229/52 B |

*Primary Examiner*—Davis T. Moorhead

*Attorney, Agent, or Firm*—Evelyn M. Sommer

[57] ABSTRACT

A carton provided with an integral, pivotable carrying handle on the top wall. The handle is a portion of a unitary blank of paperboard stock used to form the carton. When the carton is erected, the handle can be pivoted from a substantially flat stored position on the top wall to an upright use position for carrying the carton. The handle is formed from three overlapping panels after the blank is folded to provide a handle having superior strength.

6 Claims, 8 Drawing Figures

CARTON WITH INTEGRAL REINFORCED CARRYING HANDLE

BACKGROUND OF THE INVENTION

1. Field of the Invention:

This invention relates to a carton construction, and more particularly, a carton construction provided with an integral handle on the top thereof for carrying the carton and its contents.

Heretofore, it was common practice to affix a separate paper handle to the top of a carton construction, e.g., a carton filled with laundry detergent, so the carton and its contents could be conveniently carried out of a retail establishment by a purchaser.

Due to the slow speed of applying the combination paper and plastic handle to the carton during fabrication, cost of construction has become excessive. Users, therefore, have created a demand for a less costly handle system, which is required on such cartons because of its bulk and weight.

Accordingly, this invention provides a handle integrally affixed to the carton blank in such a manner so that it can be formed expediently along with the erection of carton blank. The handle is also provided with a reinforcement to tearing and rupture at its joinder to the carton. Since the handle is integrally formed with the carton blank, it is also conveniently available for use by the carton consumer, who need only bend it out of the plane of the top of the carton to a substantially upright condition ready for use.

A similar carton was disclosed in our copending application being filed concurrently herewith and entitled "Carton With Integral Carrying Handle". In that application, a paperboard blank is provided having front, back and side panels which are connected by and folded about vertical score lines to form a rectangular parallelopiped enclosure or carton. Each of the front, back, and side panels include upwardly and downwardly extending substantially rectangular flaps connected to the panels by horizontal score lines. When the flaps are folded, a bottom and top wall for the enclosure is provided.

Die-cut in the upwardly extending flaps connected to the front and back panels, respectively, are mating handle elements, which when glued together, form an integral handle with the top wall of the carton which can be pivoted from a stored or non-use position lying substantially flat on the carton top wall to a substantially upright position perpendicular thereto.

Each handle element is die-cut from the top edge of the upwardly extending flap along diverging lines towards the front and back wall portions of the front and back panels, respectively, of the blank. Then, the handle element is scored substantially parallel to the top edge of its respective front and back flap to form a hinge therefor. A rectangular portion is die-cut from the interior of each handle element, but the lowermost edge thereof is left intact with the remainder of the flap adjacent the score line.

During assembly, the upwardly extending flaps connected to the front and back panels are folded into overlapping condition. One of the handle elements on either the front or back flaps is bent back upon itself 180° about its joining score lines to present a complementary surface facing the other handle element. The facing surfaces, as well as the overlapping flaps including the rectangular die-cut portion, can then be glued together.

The secured handle elements will lie substantially flat on the top wall of the carton, but can be pivoted about the score lines to a substantially upright condition.

In order to reinforce the joinder of the handle to the top wall of the carton, a pressure sensitive type tape is applied in a continuous strip across the entire width of the carton so as to lie just below and parallel to the joinder score line hinges of each handle element. This aids in precluding the handle from tearing or rupturing from the carton when the weight of the carton and its contents are supported by the handle.

SUMMARY OF THE INVENTION

To further strengthen the integral handle structure just described, an additional handle element comprising the mirror image of one of the handle elements, may be joined by a score line hinge to the top edge of one of the two handle elements glued together. When the handle elements are joined, the additional handle element may be pivoted 180° to overly the joined handle elements to provide a thickener reinforcement element. A tab joined to the lower edge of the additional handle element by a score line is rotated 180° around the lower edges of all the overlying handle elements to join the additional handle element to the others, and serve as a finger guard when carrying the carton.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
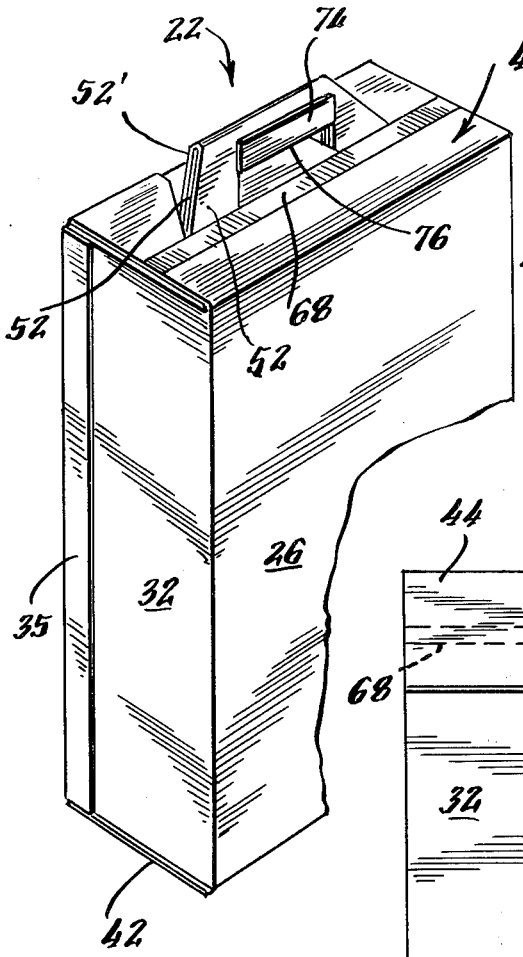
FIG. 1 is a fragmentary perspective view of a carton provided with the integral carrying handle of the present invention.
Figure 2:
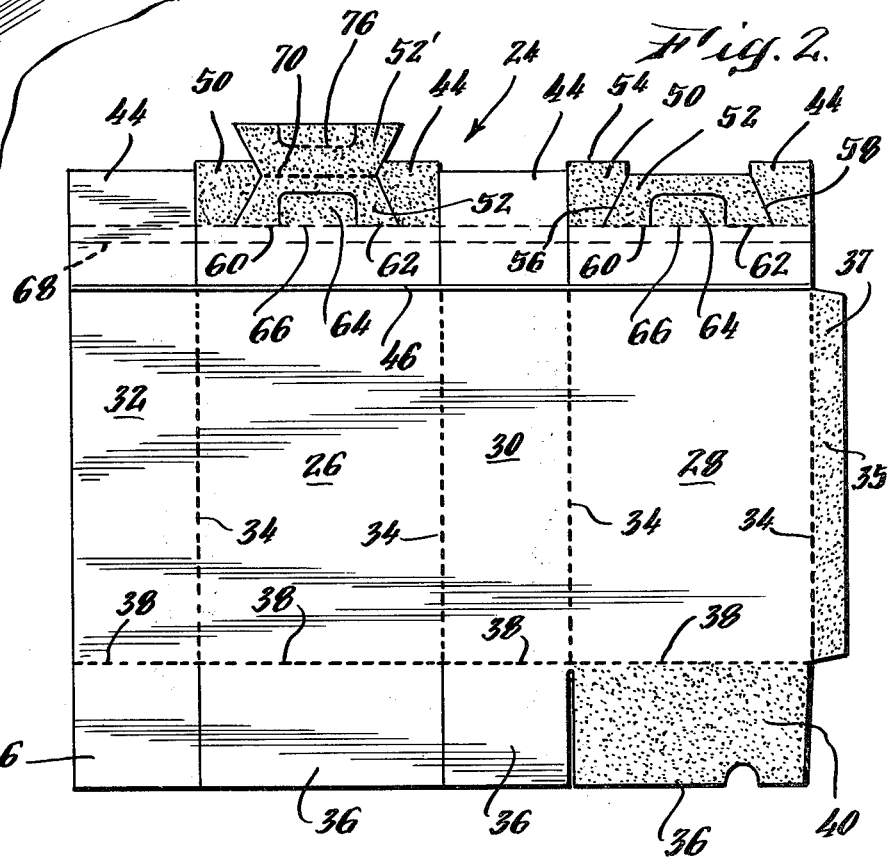
FIG. 2 is a plan view of a blank for forming the carton of FIG. 1.
Figure 3:
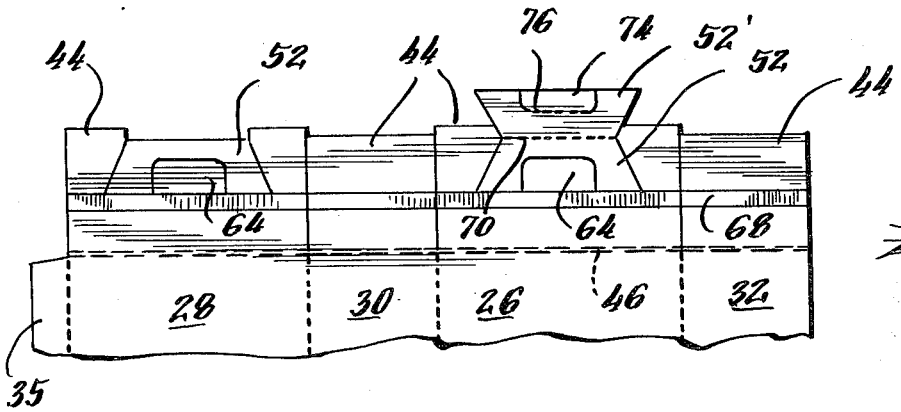
FIG. 3 is a plan view of the top portion of the opposite side of the blank of FIG. 2.
Figure 4:
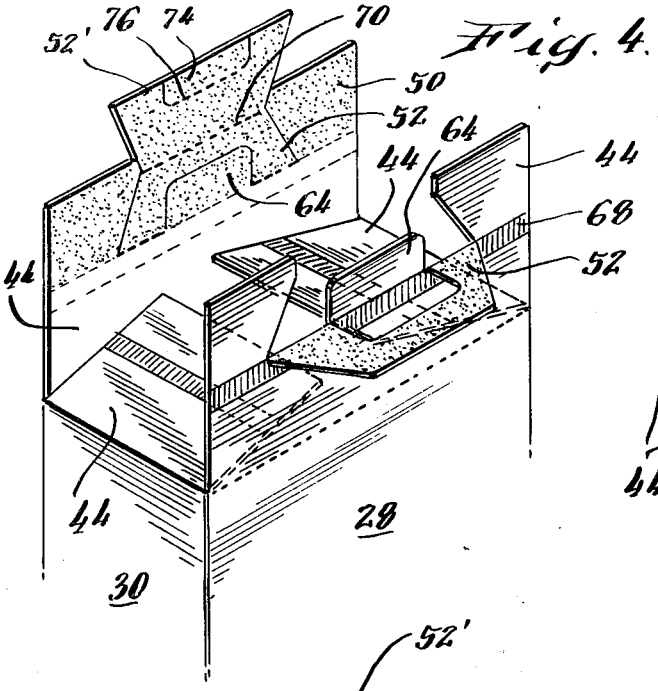
FIGS. 4 to 7 are perspective views illustrating the manner of forming the carton of FIG. 1 from the blank of FIG. 2.

Referring now to the drawings in detail, wherein like numerals indicate like elements throughout the several views, a carton 20 having an integral carrying handle 22 is formed from a paperboard blank 24 having a front panel 26, a back panel 28, and a pair of side panels 30 and 32, which are connected by and folded about vertical score lines 34 to form a substantially rectangular parallelopiped enclosure.

Connected by a vertical score line 34 to the free edge of back panel 28 is an extension flap 35, provided with an adhesive surface 37. Flap 35 is bent about the free edge of side panel 32 and adhered thereto to maintain the rectangular configuration of carton 20. Alternatively, the opposite surface of flap 35 can be provided with adhesive and the flap connected to the interior surface of side panel 32.

Each of the front, back, and side panels includes a downwardly extending, substantially rectangular flap 36 connected to its respective panel by a horizontal score line 38. The flap 36 connected to back panel 28 has an adhesive surface 40. When flaps 36 are folded about score lines 38, the flaps connected to the front and back panels overlap the flaps connected to the side panels and each other to form a bottom wall 42 for carton 20. The surface 40 can be adhesively connected to the lower surface of the flap 36 connected to the front wall 26 to retain the bottom wall together.

Each of the front, back and side panels also includes an upwardly extending, substantially rectangular flap 44 connected to its respective panel by a horizontal, reinforced rib 46 extending the entire width of blank 24. Rib 46 serves as a reinforced hinge about which each of the flaps 44 can be bent and overlapped to form the top wall 48 of carton 20. When bent, one of the flaps 44 connected to the back or front panel completely overlies the flaps 44 connected to the side panels (as shown in FIGS. 4 to 7), while the other of the flaps 44 connected to the back or front panel overlaps the one flap 44 overlying the flaps connected to the side panels. To retain the flaps closed on the carton 20, each of the flaps 44 connected to the front and back panels has an adhesive surface 50; the adhesive surface on the one back or front flap 44 being secured to the top surface of the side flaps 44, while the other back or front flap 44 being secured to the top surface of the one back or front flap.

Figure 7:
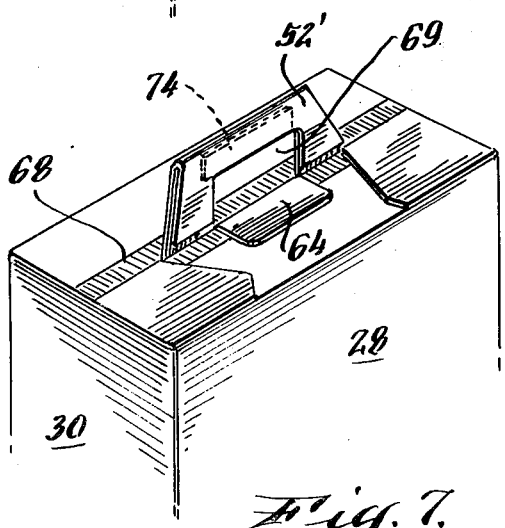
Figure 8:
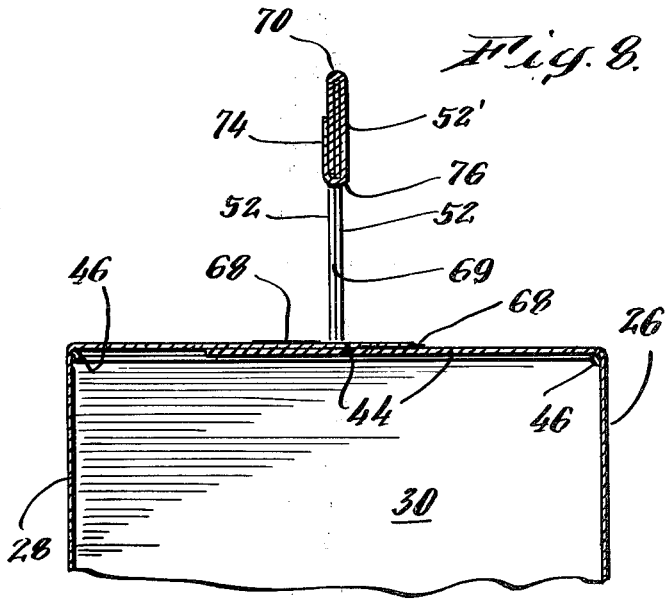
FIG. 8 is a longitudinal cross-sectional view of the carton of FIG. 1.

Die-cut in the upwardly extending flaps 44 connected to the back and front panels 28 and 26, respectively, are mating handle elements 52, which when glued together, form a portion of the integral handle 22 for carton 20, which can be pivoted from a stored or non-use position lying substantially flat on the carton top wall 48 to a substantially upright position perpendicular thereto, as shown in FIGS. 1, 7 and 8.

Each handle element 52 is die-cut from the top edge 54 of the upwardly extending flap 44 along spaced diverging lines 56 and 58 towards the front and back wall portions of the front and back panels 26 and 28, respectively, of the blank 24. Then, the handle element is scored substantially parallel to the top edge of its respective front and back flap at 60 and 62, to form a hinge therefor. A rectangular portion 64 is die-cut from the interior of each handle element, but the lowermost edge 66 thereof is left intact with the remainder of the flap 44 adjacent to and contiguous with the score lines 60 and 62.

Figure 5:
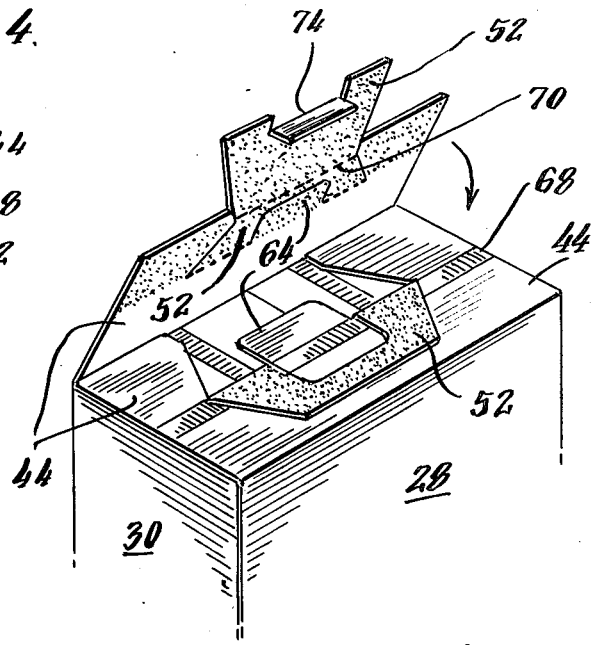

As shown in FIGS. 4 to 7, inclusive, during assembly, the upwardly extending flaps 44 connected to the front and back panels are folded into overlapping condition. One of the handle elements 52 on either the front or back flaps 44 is bent back upon itself 180° about its joining score lines 60 and 62 to present a complementary surface facing the other handle element 52 (FIG. 5). The facing adhesive surfaces 50, as well as the remainder of the overlapping flaps 44 including the rectangular die-cut portions 64, can then be glued together.

The secured handle elements 52 can be pivoted together about their score lines 60 and 62 to a substantially upright condition, providing an aperture 69 to receive the fingers of a hand. The aperture 69 is formed by the non-pivotable portions 64 of each handle element being held rigidly adhered together on the top wall 48 of carton 20.

In order to reinforce the joinder of the handle 22 to the top wall 48 of the carton 20, a pressure sensitive type tape 68 is applied in a continuous strip across the entire width of the carton 20 on the outer surface of blank 24 before the flaps are cut, so as to lie just below and parallel to the joinder score line hinges 60 and 62 of each handle element 52. This aids in precluding the handle from tearing or rupturing from the carton when the weight of the carton and its contents are supported by the composite, integral handle 22. Alternatively, tape 68 may be applied across the entire width of the inner surface of blank 24 below and parallel to hinges 60 and 62 or if the paperboard of the blank is of a two-ply construction, the tape may be sandwiched between the plies adjacent hinges 60 and 62. The tape may have a mesh construction, if desired, and may in the laminated version be disposed along the entire length and width of the panels 44.

In lieu of a pressure sensitive or mesh tape, the reinforcement may be supplied by utilizing specially designed embossings or debossings on the blank which surround the handle structure. By incorporating such embossments or debossments, not only can reinforcement of the handle be achieved, but end panel dimensional disparity of the entire end flap configuration is reduced when the flaps are folded into their final configuration. Additionally, the embossing and debossing allows the end flaps to interlock thereby providing more positive glue adhesion and more resistance to breakage where the carton is subjected to dropping and lifting.

Figure 6:
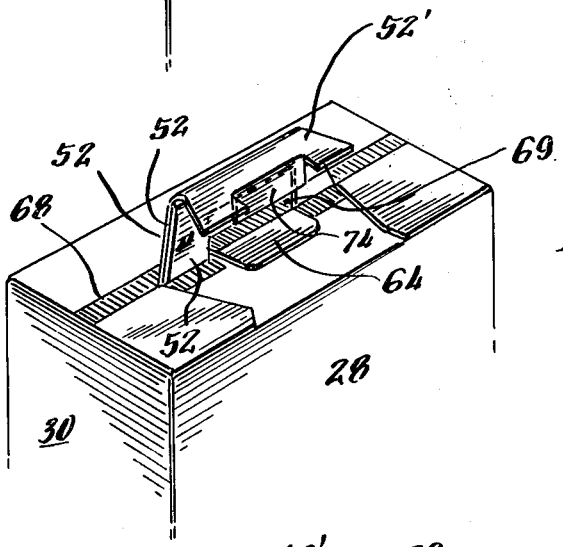

To further strengthen the integral handle structure, an additional handle element 52' comprising the mirror image of one of the handle elements 52, may be joined by a score line hinge 70 to the top edge of the handle element in blank 24. When the handle elements 52 are joined, the additional handle element 52' may be pivoted 180° about hinge 70, as illustrated in FIGS. 6 and 7, to overly the joined handle elements 52 to provide a thickener reinforcement element. A tab 74 joined to the lower edge of the additional handle element by a score line 76 may also be rotated 180° about score line 76 around the lower edges of the joined handle elements 52 to join the additional handle element 52' to the others, and serve as a finger guard when carrying the carton, precluding cutting of the fingers by the bottom of handle elements 52.

The secured handle elements 52, 52 and 52' can be pivoted about their score line hinges, if desired, to lie substantially flat on the top wall 48 of the carton 20, and thus be stored when not in use.

What is claimed as new is:

1. A carton comprising:

opposed front and back walls joined by opposed side walls;

a bottom and top wall between said front and back walls, said top wall including at least two overlapping flaps, one of said flaps being hingedly connected to said front wall and the other of said flaps being hingedly connected to said back wall;

a handle element cut in each of said flaps, each of said handle elements including:

outer edges formed by spaced lines cut in each of said flaps extending inwardly from a top edge thereof;

a score line hinge extending towards each other from an end of each of said outer edges generally parallel to the top edge of the flap; and a a central portion cut from the flap between said score line hinges, defining a lower edge on said handle element generally parallel to the top edge of said flap;

whereby one of said handle elements can be bent substantially 180° about its score line hinges when said flaps are overlapped, and the other of said handle elements complementally seated thereon;

said complementally seated surfaces of said handle elements being secured together to form an integral handle on said top wall pivotable about said score line hinges from a substantially flap position on said top wall to a substantially upright position relative thereto so that said carton may be supported by said handle;

and additional handle element integral with one of said handle elements cut in one of said flaps, said additional handle element being secured by a hinge score line to a top edge of said one handle element, said additional handle element having outer dimensions which are the mirror image of said one handle element:

whereby after said handle elements are secured together to form an integral handle, said additional handle element can be bent substantially 180° about the score line hinge securing it to said one handle element into overlapping relation with said integral handle to reinforce the same;

said additional handle element including:

a central portion cut from the interior thereof to define a lower edge on said additional handle element generally parallel to the score line hinge securing it to said one handle element;

a second score line hinge between said lower edge and said score line hinge securing said additional handle to said one handle element to define a tab on said additional handle element;

said central portion of each of said handle elements being substantially rectangular in plan and cut along three edges, the intact edge of said central portion being between said score line hinges;

said central portion of each handle element being overlapped and secured together;

whereby after all of said handle elements are placed in overlapping relation, said tab can be rotated 180° to secure said additional handle element to said other handle elements;

said carton further including:

a strip of reinforcing tape adhered to each of said flaps parallel to and just below the score line hinges of each handle element, said tape extending across the entire width of the flaps.

2. The carton of claim 1 wherein said tape is on the outer surface of said flaps.

3. The carton of claim 1 wherein said tape is on the inner surface of said flaps.

4. The carton of claim 1 wherein said flaps are formed from two-ply paperboard and said tape is sandwiched between said plies.

5. The carton of claim 1 wherein said tape is of the pressure-sensitive type.

6. The carton of claim 1 wherein said tape is of a mesh construction.

* * * * *